United States Patent [19]

Price

[11] Patent Number: 4,941,756

[45] Date of Patent: Jul. 17, 1990

[54] DISPOSABLE BAG WITH ATTACHED NAPKIN

[75] Inventor: John S. Price, 28 Lauretta Dr., Highland, N.Y. 12528

[73] Assignee: John Sterling Price, Highland, N.Y.

[21] Appl. No.: 331,831

[22] Filed: Apr. 3, 1989

[51] Int. Cl.[5] ..... B65D 30/02; B65D 30/10

[52] U.S. Cl. ..... 383/127; 383/4; 206/233; 206/542; 206/632

[58] Field of Search ..... 383/4, 12, 13, 70, 71, 383/127; 229/DIG. 13, 87 F; 206/233, 542, 548, 632, 831; 426/115, 124

[56] References Cited

U.S. PATENT DOCUMENTS 4,484,350 11/1984 Gordon ..... 383/127 X 4,542,050 9/1985 Gallant ..... 383/4 X 4,618,992 10/1986 La Grotteria ..... 383/127 X

FOREIGN PATENT DOCUMENTS 176926 10/1906 Fed. Rep. of Germany ..... 383/71

290162 2/1916 Fed. Rep. of Germany ..... 383/127

321543 6/1920 Fed. Rep. of Germany ..... 383/127

*Primary Examiner*—Stephen Marcus

*Assistant Examiner*—Jes F. Pascua

[57] ABSTRACT

A bag for the storage and carrying of food with an attached napkin. The bag and napkin are attached by virtue of a seam which is also intended by design to allow or indicate where separation of said bag and napkin is to occur by virtue of tearing, cutting or other manual action.

4 Claims, 1 Drawing Sheet

DISPOSABLE BAG WITH ATTACHED NAPKIN

Reference Cited: U.S. Pat. No. 3,606,138

BACKGROUND OF THE INVENTION

This invention relates to food storage, consumption and personal hygiene.

The intent of this invention is to provide immediate and simple access to a means for personal cleanliness after the consumption of food stored within said invention, a bag with an attached napkin.

In the accompanying drawings, one may see that the attachment of said napkin requires a special provision, the introduction and novel application of a manufactured seam which serves the purposes of both joining the napkin and bag, and facilitating their separation.

DETAILED DESCRIPTION OF DRAWINGS

Figure 1:
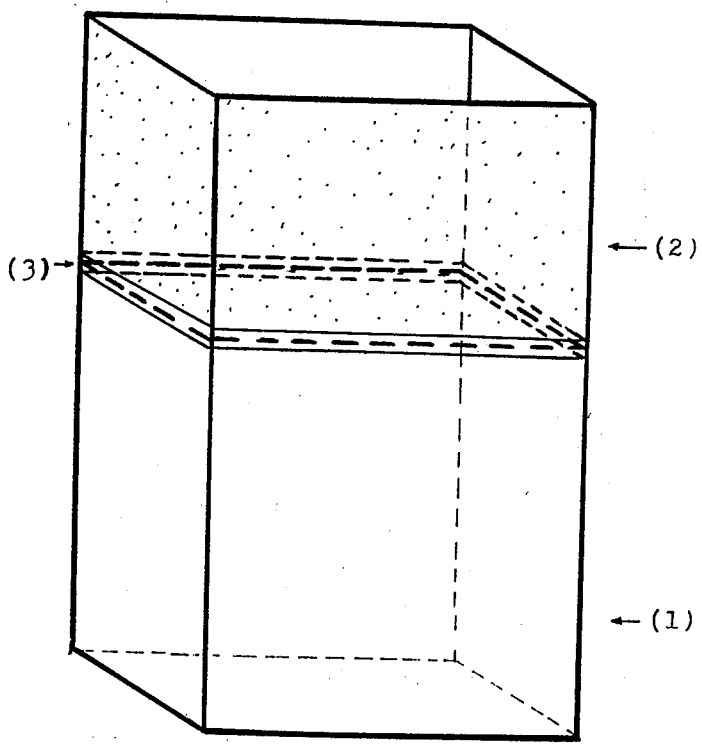
FIG. 1 is an over view of the invention, in perspective, showing the absorbent material, the seam by which it is attached, and the remaining body of the bag.
Figure 2:
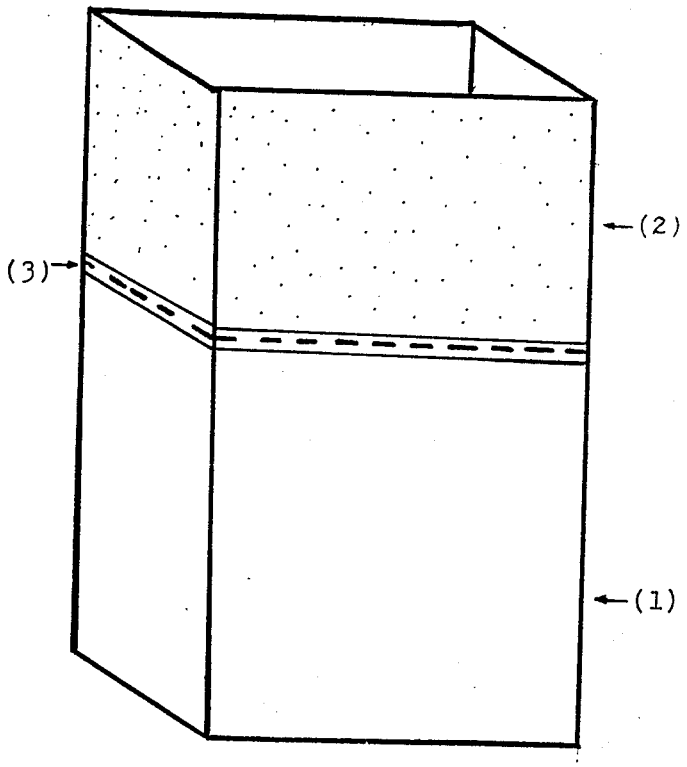
FIG. 2 is the same perspective with the hidden lines removed.

FIG. 1 & 2 show a bag (1) with absorbent material (2) attached by virtue of a manufactured seam (3), as described in the claims of this patent.

The bag and napkin may be manufactured from paper, cloth or any suitable material(s), and the proportions shown are for convenience of drawing only.

DETAILED DESCRIPTION OF INVENTION

This invention resides in a bag with at least one ply of absorbent material attached to it by virtue of a manufactured seam.

The bag is so constructed that the consumer may detach the napkin from the bag by severing it along a seam running between them. After detachment the absorbent portion may be put to the usual uses of a napkin or small towel (e.g. removal of food stuff remnants, spills etc.).

It is the novel merging of two dissimilar utilitarian components and a method for using them to a singular end (the convenient and hygienic consumption of food) which is the residence of this invention.

Although the material most readily is adaptable to the production of this invention is paper, there is no intention here to exclude the use of other materials, such as cloth or plastic, or any combination of materials. The napkin consists of absorbent material, and may be of one (1) or several plies or sheets folded otherwise arranged to allow attachment to said bag.

Although the seam is more particularly referred to as adhesive, semi-adhesive, perforated or a combination thereof, this is not to preclude other methods which may secure separation. Such as potential separation line may include only a series of printed dashes or dots to indicate where the division of materials accomplished by mere tearing or cutting, or a line of stress or physical weakening between said materials.

Therefore it should be understood that the structural characteristics of the seam are not essential to the broader aspects of this invention.

I claim:

1. A bag of flexible material comprising:

an open bag mouth;

at least one napkin of absorbent material wherein said at least one napkin is releasably connected to the bag about the open bag mouth by adhering means such that the connection defines an overlapping seam.

2. A bag as claimed in claim 1 wherein said at least one napkin is of at least one ply of absorbent material.

3. A bag as claimed in claim 1, wherein said adhering means is an adhesive.

4. A bag as claimed in claim 1 wherein said adhering means is a semi-adhesive.

* * * * *